United States Patent [19]

Remington

[11] Patent Number: 4,898,310

[45] Date of Patent: Feb. 6, 1990

[54] CENTER OF GRAVITY HOLSTER

[75] Inventor: Robert W. Remington, Kamiah, Id.

[73] Assignee: Claude R. Wimer, Jr., Naples, Fla. ; a part interest

[21] Appl. No.: 784,492

[22] Filed: Oct. 4, 1985

[51] Int. Cl.[4] ..... F41C 33/02

[52] U.S. Cl. ..... 224/238; 224/911; 224/907; 224/240; 224/198

[58] Field of Search ..... 224/238, 911, 907, 240, 224/198, 224

[56] References Cited

U.S. PATENT DOCUMENTS

| | | | |
|---|---|---|---|
| 1,453,671 | 5/1923 | Harrold | 224/907 X |
| 3,915,361 | 10/1975 | Perkins | 224/198 X |
| 4,029,243 | 6/1977 | Zerobnick et al. | 224/224 |
| 4,057,181 | 11/1977 | Finnigan | 224/911 X |
| 4,410,118 | 10/1983 | Taurisano | 224/911 X |
| 4,480,776 | 11/1984 | Atkins, Sr. | 224/911 X |

FOREIGN PATENT DOCUMENTS

| | | | |
|---|---|---|---|
| 2754061 | 6/1979 | Fed. Rep. of Germany | 224/907 |

*Primary Examiner*—Henry J. Recla
*Attorney, Agent, or Firm*—Brady, O'Boyle & Gates

[57] ABSTRACT

A pistol holster is worn within the recess defined by the small of the back and includes an attached pad which engages the back in this region and an adjustable padded support belt which snugly embraces the waist of the wearer substantially at the anatomical center of gravity. The holster body and the weapon contained therein are set at an angle to the horizontal plane through the anatomical center of gravity in which the support belt is located and the particular angle of inclination of the holster body is determined by the line of balance of the particular type of pistol being held in the holster through the center of gravity of the pistol. The center of gravity of the wearer is correlated with the center of gravity of the pistol being held in the holster to promote comfort and safety and freedom from injury during all types of physical activity required by specialized military personnel, S.W.A.T. team members and woodsmen.

11 Claims, 5 Drawing Sheets

CENTER OF GRAVITY HOLSTER

BACKGROUND OF THE INVENTION

Traditional pistol holsters worn on the hip or shoulder present serious difficulties to certain military and police personnel as well as hunters-woodsmen. The most obvious difficulty inherent in the holster worn in the hip-thigh region is its impediment to running. Anyone observing a policeman running after a criminal suspect has noticed the officer gripping his pistol holster with one hand and attempting to steady it against the thigh during the pursuit of the criminal. Running under these conditions is very difficult because of the uncoordinated movements of the leg and the holstered weapon. To a somewhat lesser degree, the weapon carried beneath the arm and in the rib area in a shoulder holster also tends to be subject to uncontrolled movement during running. Also, the weight of a weapon carried in the traditional position pulls the muscle and bone structure of the body out of balance and alignment so that carrying a weapon for extended periods becomes fatiguing and uncomfortable.

Both traditional types of pistol holders become extremely uncomfortable, and can in fact inflict serious injuries on the wearer, as where the wearer falls to the ground and lands on the holster or must crawl or roll on the ground. This latter type of activity is required frequently of military special forces, or commandos, police S.W.A.T. teams and the like.

Furthermore, the possibility of the conventionally holstered weapon discharging during extremely strenuous activity by the wearer and inflicting a serious or mortal injury is also present.

The present invention, therefore, has for its objective to overcome the above and other recognized drawbacks present in traditional pistol holsters by providing a holster whose physical construction and location on the body of the wearer, and the materials from which the holster is made depart radically from the prior art, with the result that a much more comfortable, secure and safer arrangement results, with a greatly lessened likelihood of injury to the wearer during the most strenuous activities, such as running, leaping, climbing and crawling.

A major objective and advantage realized with the present invention is to make use of the anatomical center of gravity of the wearer of the pistol holster and the center of gravity and balance of the holstered weapon itself. More particularly, it is an established fact that the region of the human body which is subject to the least degree of movement during a variety of physical activities is that region where the anatomical center of gravity is located. The present invention takes advantage of this phenomenon by locating the holstered weapon in a plane passing through the anatomical center of gravity. The holstered weapon is also located within the natural recess defined by the small of the back, which contributes greatly to comfort and safety when the wearer of the holstered weapon is forced to lie on the back as during crawling and rolling activities required of military special forces and similar personnel.

The invention also takes advantage in a unique way of the center of gravity of the holstered weapon and its line of balance through its center of gravity. The center of gravity of the holstered weapon is uniquely correlated with the anatomical center of gravity and the placement of the holstered weapon in the natural curved recess adjacent to the small of the back to provide a most stable and safe mounting for the holstered weapon on the body, with greatly reduced relative movement between the holstered weapon and the body of the wearer during running and other physical activity. The improved holster in accordance with the present invention is rendered further efficient through the provision of an adjustable snug-fitting padded support belt which is disposed in a horizontal plane intersecting the centers of gravity of the wearer and of the holstered weapon.

An objective of the invention is to provide an improved pistol holster of the character described which can accept various types of weapons including the newest U.S. military pistol, the 0.44 Magnum revolver, and the 9 mm Uzi assault pistol. In accordance with the present invention, each of the above weapons is held in a holster with the axis of its barrel arranged at a particular angle of inclination relative to the horizontal plane through the anatomical center of gravity, which is the plane occupied by the holster support belt. This angle of inclination will vary for each type of weapon and is determined by its balance axis through the center of gravity of the holstered weapon.

Further objects of the invention are to provide a holster which provides easy access to the weapon, a holster which is practical and relatively inexpensive to manufacture, and a holster constructed from durable materials which promote comfort and safety while fully protecting the weapon from the elements, such materials representing a drastic departure from leather, the most commonly used material in the prior art.

Other features and advantages of the invention will become apparent to those skilled in the art during the course of the following detailed description.

DETAILED DESCRIPTION

Figure 1:
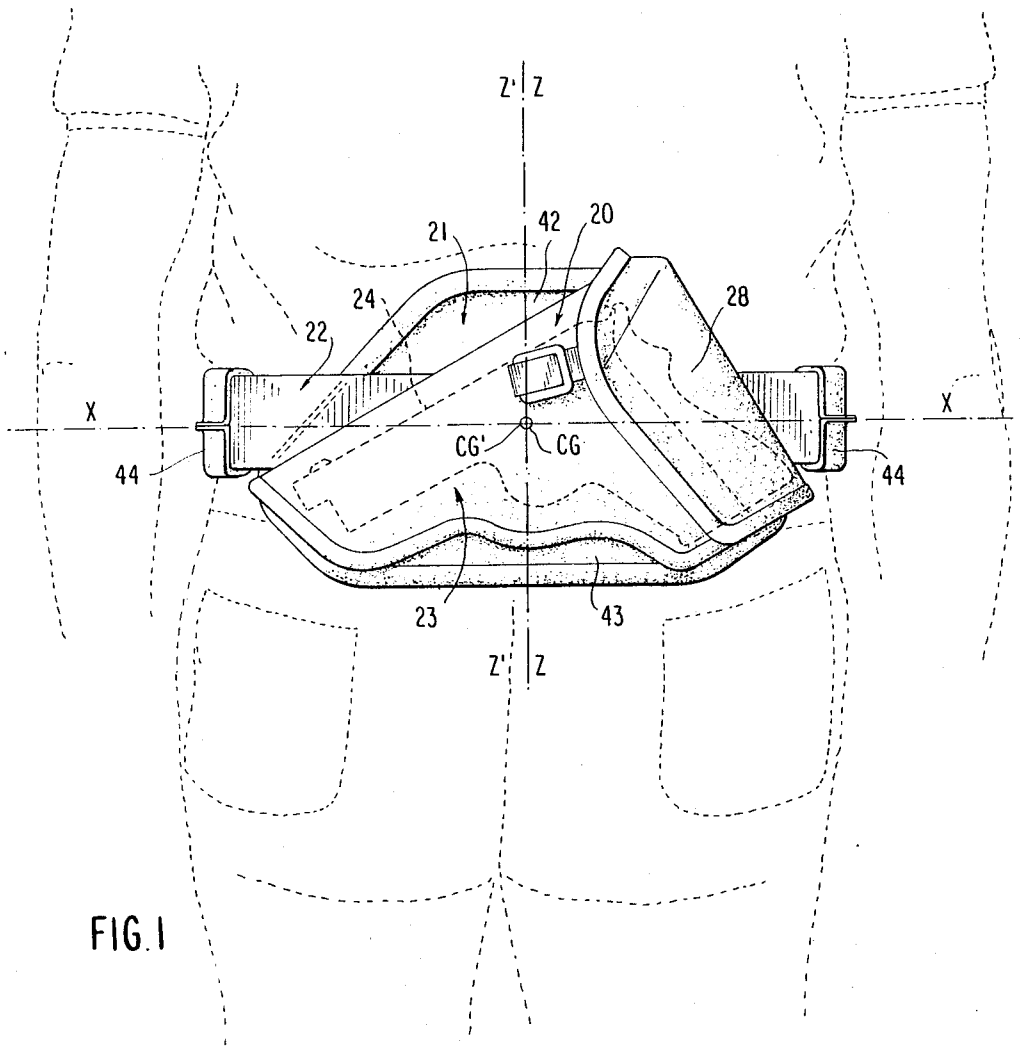
FIG. 1 is an exterior elevation of a center of gravity holster according to one embodiment of the invention in the use position on the back of a wearer, the wearer being shown in broken lines.
Figure 2:
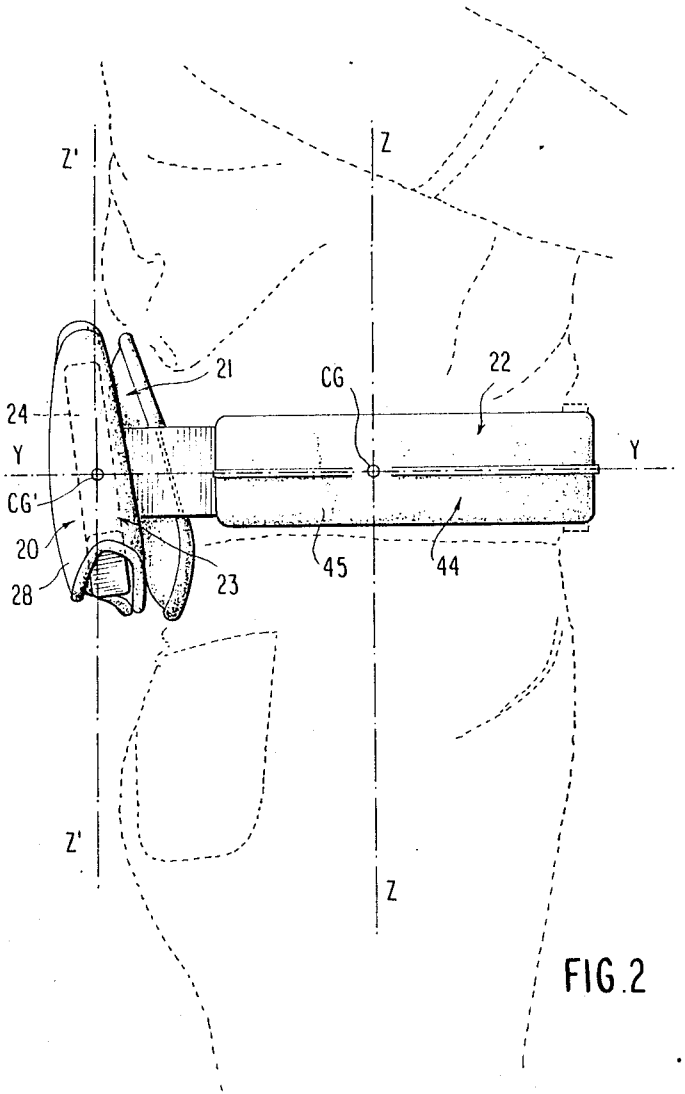
FIG. 2 is a side elevation of the holster and wearer taken at right angles to FIG. 1.

Referring to the drawings in detail, wherein like numerals designate like parts, and referring first to FIGS. 1 and 2, a pistol holster assembly 20 according to one embodiment of the present invention comprising the holster body 23 and its attached back cushioning pad 21 and adjustable padded support belt 22 is shown mounted on a wearer whose body contours are shown in broken lines in the two drawing figures.

The approximate anatomical center of gravity of the wearer of the holster is indicated at CG in FIG. 2, lying on the intersection of a horizontal front-to-back Y-axis and a vertical or Z-axis through the center of the body of the wearer. The Y-axis, also through the center of the body, ideally intersects the navel.

The anatomical center of gravity, CG, is also shown in FIG. 1 at the intersection of the Z-axis with a horizontal or X-axis across the body of the wearer, from side-to-side thereof, at the same elevation as the Y-axis.

The holster body 23, shown in FIGS. 1 and 2, receives a pistol 24, such as the new U.S. military pistol, namely, a 9 mm Baretta semi-automatic pistol. The holster body will also accept a 0.45 caliber, Colt semi-automatic pistol and others.

In accordance with an important aspect of the invention, the center of gravity of the holstered pistol 24 designated CG′ lies on the intersection of the Y-axis with a vertical axis Z′—Z′, and referring to FIG. 1, the pistol center of gravity CG′ lies on the intersection of the X-axis with the Z′—Z′ axis, the latter axis coinciding with the Z-axis.

The particular pistol 24 within the holster body 23, having the center of gravity, CG′, also has a balance point coincident with the center of gravity CG′, which, for a given pistol, will establish an angle of inclination assumed by the barrel axis of the pistol relative to the X-axis or the horizontal, and consequently the angle of inclination of the holster body 23 relative to the horizontal support belt 22 of the holster assembly 20. The total relationship of the anatomical center of gravity CG with the pistol center of gravity CG′ and the balanced inclination of the pistol barrel axis in the holster assembly 20 is what provides the stability in the assembly on the body of the wearer, at rest, and during many types of intense physical activity. Since the movement of the human body at the center of gravity CG is minimized in all types of activity, there is a drastically lessened tendency for the holster assembly in general, and the holster body 23 in particular, to be displaced on the body of the wearer during various physical activities, as explained previously. This is all in sharp contrast to what happens in the prior art where hip and shoulder holsters are commonly employed.

The physical construction of the holster assembly greatly contributes to the above-stated advantages derived from the geometry of the assembly relative to the body of the wearer. Rather than being formed of leather or like stiff material possessing little, if any, cushioning ability, the components of the holster assembly 20 are formed of lightweight but extremely durable textile fabric and associated padding.

More particularly, the holster body 23 consists of inner and outer layers 25 and 26 intervened by compressible preferably closed cell moisture-impermeable cushioning material 27, the holster body being shaped to receive the described type of weapon 24. The holster body is equipped with a rear flexible closure flap 28 having a preferably Velcro component 29 on the inner face thereof adapted to coact with a mating Velcro component 30 on the exterior of the holster body 23. The holster body is also equipped with an adjustable length safety strap 31 by means of which the weapon 24 is releasably held in the holster body 23 until the strap 31 is released. The strap is secured by a snap fastener means 32 on the holster body, the strap having a mating snap fastener component.

The holster body cushioning or back pad 21 similarly comprises inner and outer layers 33 and 34 of woven textile material containing between them a relatively thick layer 35 of cushioning material, identical to the described material 27 of the holster body 23. The back pad 21 is somewhat compliant so that it can conform or mold itself to the contours of the wearer, in the region of the small of the back, FIG. 2, where the holster body 23 and back pad 21 are located during use. It can be observed in FIG. 2 that the natural curved recess defined by the small of the back can contain the holster body 23 and back pad substantially within it, so as to minimize protrusion of the holster body from the back of the wearer. This arrangement maximizes comfort and minimizes the danger of injury from falling on the back during physical activity or from merely lying on the back. The placement of the back pad 21 and holster body within the natural cavity in the small of the back further contributes to minimizing movement of the holster assembly during running or other strenuous activity, in accordance with a major feature of the invention.

Figure 3:
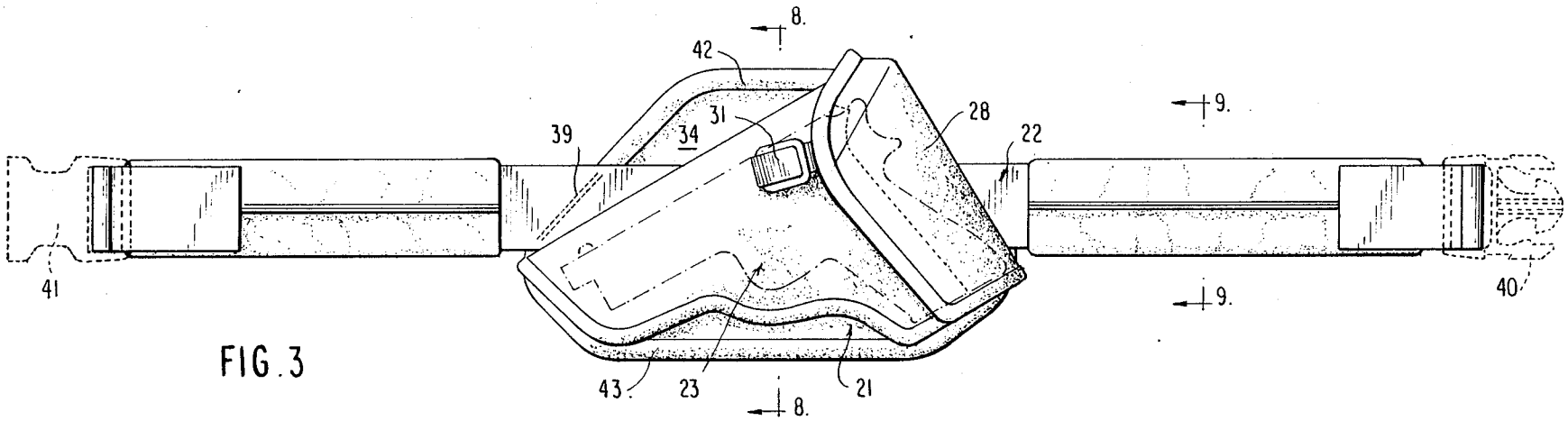
FIG. 3 is an exterior side elevation of the holster shown in FIGS. 1 and 2 with the holster support belt laid out flat.
Figure 8:
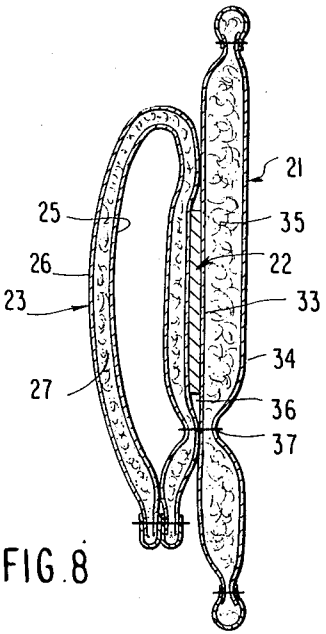
FIG. 8 is an enlarged vertical section taken on line 8—8 of FIG. 3.

A slot 36 for the support belt 22 is formed between the holster body 23 and back pad 21, FIG. 8. This slot or passageway is defined by parallel lines of stitching 37 and 38, FIG. 5, which stitching lines penetrate the back pad and the interior wall of the holster body 23, as best shown in FIG. 8. The support belt 22 is secured against longitudinal movement through the slot 36 by inclined lines of stitching 39, FIGS. 3 and 5. The support belt 22 is constructed of textile material similar to the material used to make automobile seat belts. The belt 22 is equipped at its opposite ends with conventional quick release fastener elements 40 and 41, whereby the length of the belt is adjustable at either end or at both ends, as need dictates, to maintain the holster body 23 and back pad 21 centered in the small of the back.

Figure 4:
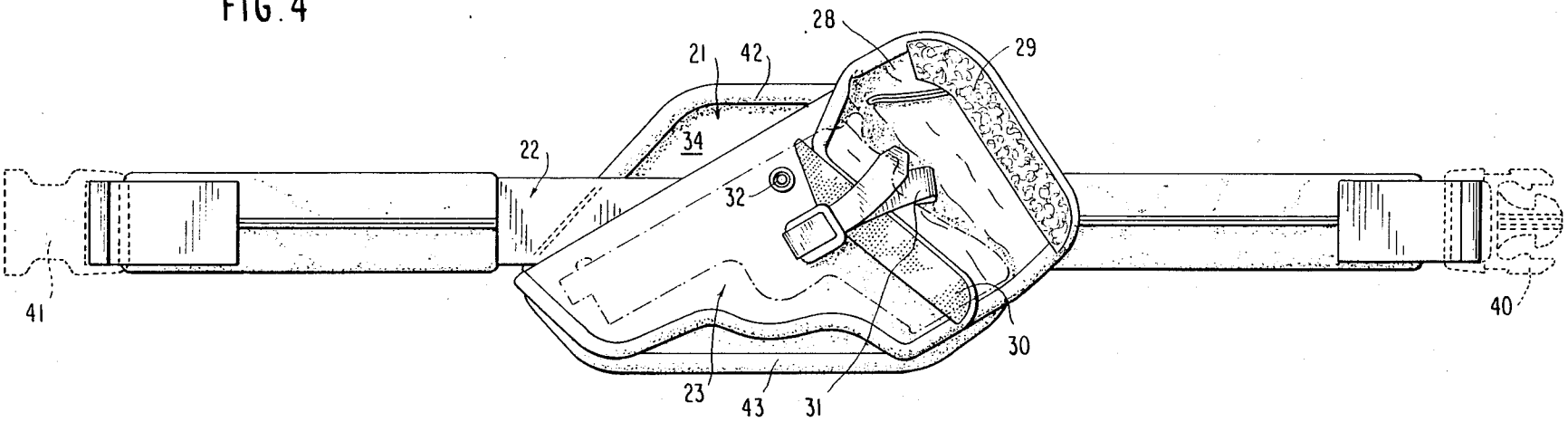
FIG. 4 is a further elevational view, similar to FIG. 3 with the closure flap of the holster open.

As shown in the drawings, the back pad 21 conforms generally to the shape of the holster body 23 when the flap 28 thereof is closed. However, referring to FIGS. 3 and 4, top and bottom edge portions 42 and 43 are provided on the back pad 21 above and below the holster body 23 for the sake of increased comfort and safety, by having a wide area of the pad 21 in contact with the back of the wearer. The pad can readily conform itself to the contours of the back, as previously stated.

Figure 9:
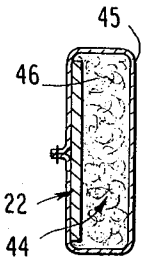
FIG. 9 is a similar section taken on line 9—9 of FIG. 3.

Because the support belt 22 is preferably snug fitting on the wearer, to further promote comfort and safety comparatively thick elongated longitudinally adjustable tubular pads 44 are provided on the belt 22 between the holster body and back pad 21 and the quick release fastener elements 40 and 41. The adjustable pads 44 comprise envelopes 45 of tough woven textile material and internal cushioning material 46 of the type previously described. The thick cushioning material, FIG. 9, is on the interior face of the belt 22 so as to be next to the body of the wearer.

Figure 5:
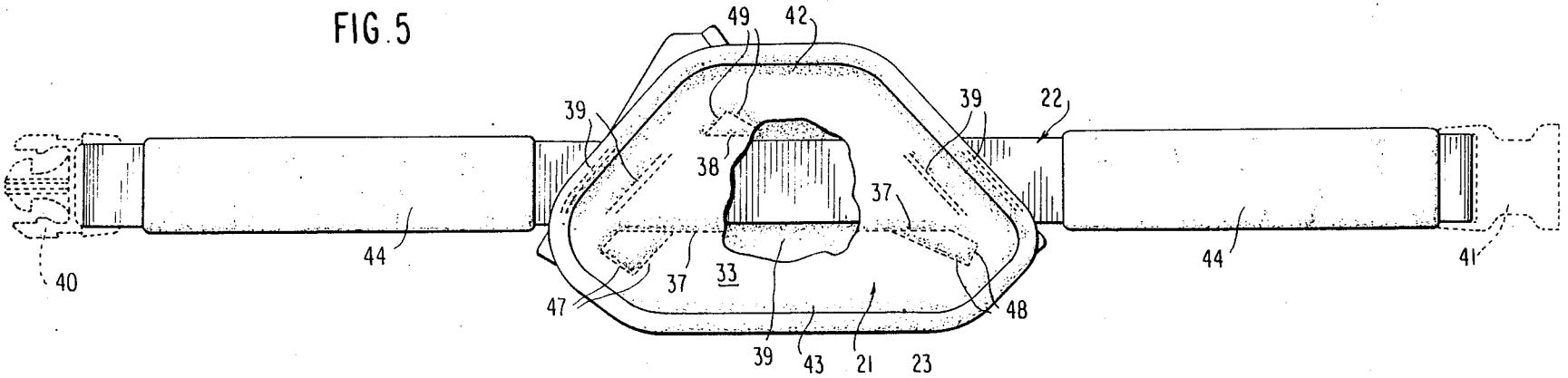
FIG. 5 is an interior side elevation of the holster and support belt, partly broken away.
Figure 6:
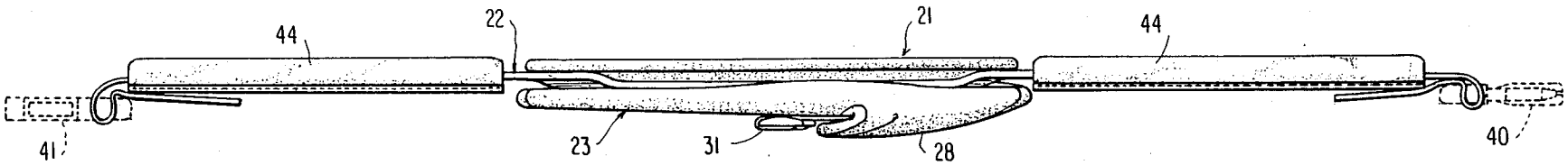
FIG. 6 is a top plan view of the holster and support belt.
Figure 7:
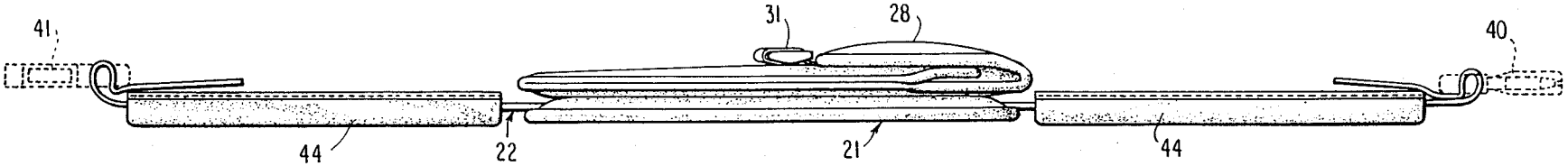
FIG. 7 is a bottom plan view thereof.

The holster body 23 has its interior wall joined to the back pad 21 by additional stitching lines 47, 48 and 49, as best shown in FIG. 5. It may be seen that the holster body 23, back pad 21 and support belt 22 are united by stitching, and only the belt pads 44 are movable on the belt 22 relative to the holster body and back pad.

Since both the back pad 21 and the holster body 23 contain internal cushioning material, as described, maximum comfort and protection for the body of the wearer is provided. Coupled with the fact that the weapon 24 in the holster body 23 is substantially within the natural cavity of the back, there is little chance of serious injury resulting from a fall on the back or similar activity.

During running and the like, the weapon and the entire holster assembly will remain relatively stationary on the body and, when taking into account that all movements of the body are minimized at the anatomical center of gravity CG, the efficiency of the holster assembly in terms of its dynamics is greatly enhanced. The additional fact that the weapon is balanced on its own center of gravity CG' and the two centers of gravity CG and CG' are physically correlated in the described manner, the stability of the entire holster assembly is greatly enhanced in comparison to the prior art.

The rather large area back pad 21 distributes the weight of the weapon substantially over the small of the back, which again promotes comfort and safety. The holster body is normally completely out of the user's way during tactical operations and yet the weapon is always positioned for instant emergency use. It is also protected from rain or ground water as where the user is crawling in water and mud.

Since the holster body 23 is recessed into the back of the wearer, there is little likelihood of it becoming snagged on anything during tactical maneuvers. The support belt 22 can always be instantly released with the thumb and fore finger of either hand by manipulation of the quick release elements 40 and 41. The inclined muzzle of the weapon always points downwardly which is a further safety advantage.

The many advantages of the invention as thus far described should now be readily apparent to those skilled in the art.

Figure 11:
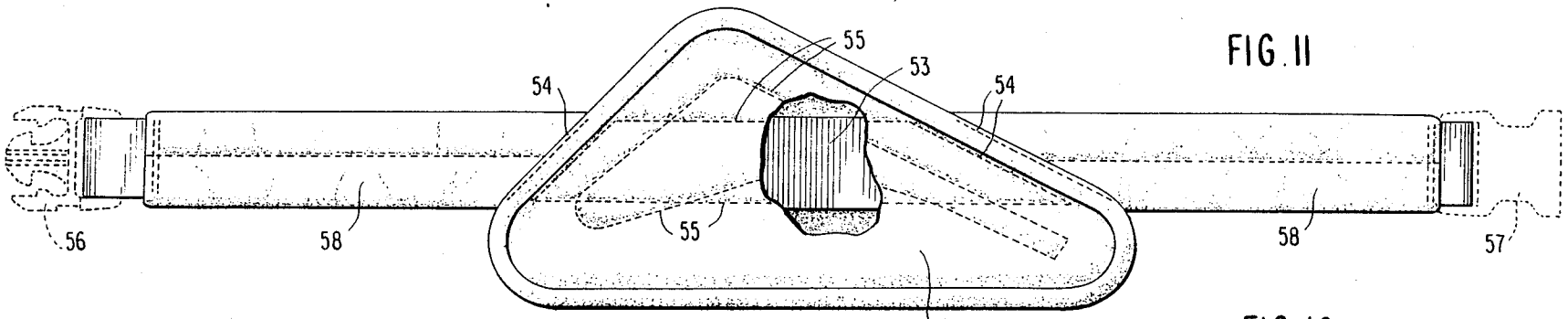
FIG. 11 is an interior side elevation, partly broken away, of a holster and support belt according to a second embodiment of the invention.
Figure 12:
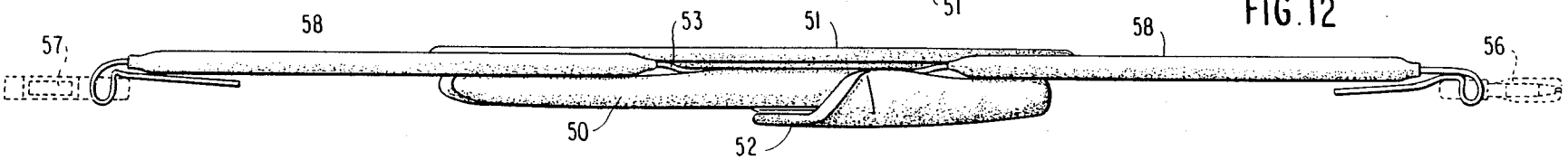
FIG. 12 is a top plan view of the holster and belt shown in FIG. 11.

With reference to FIGS. 11 and 12 of the drawings, a second embodiment of the invention is disclosed which differs from the previous embodiment mainly in that the holster body 50 is shaped to receive and hold a 0.44 Magnum revolver. The back pad 51 of the holster assembly is generally triangular and possesses the general shape of the revolver. The holster body 50 is equipped with a preferably Velcro-secured closure flap 52. Both the holster body 50 and the back pad 51 are provided with internal cushioning material in substantially the manner shown and described in connection with the prior embodiment.

The support belt 53 of the embodiment shown in FIGS. 11 and 12 is united with the back pad 51 and the holster body 50 by lines of stitching 54 and 55. There is no relative movement of the belt 53 and holster body 50 and back pad 51. The ends of the belt 53 carry individually adjustable quick-release fastener elements 56 and 57.

As in the prior form of the invention, the support belt 53 carries padding 58 on opposite sides of the back pad 51 and united therewith by the stitching lines 54.

Figure 10:
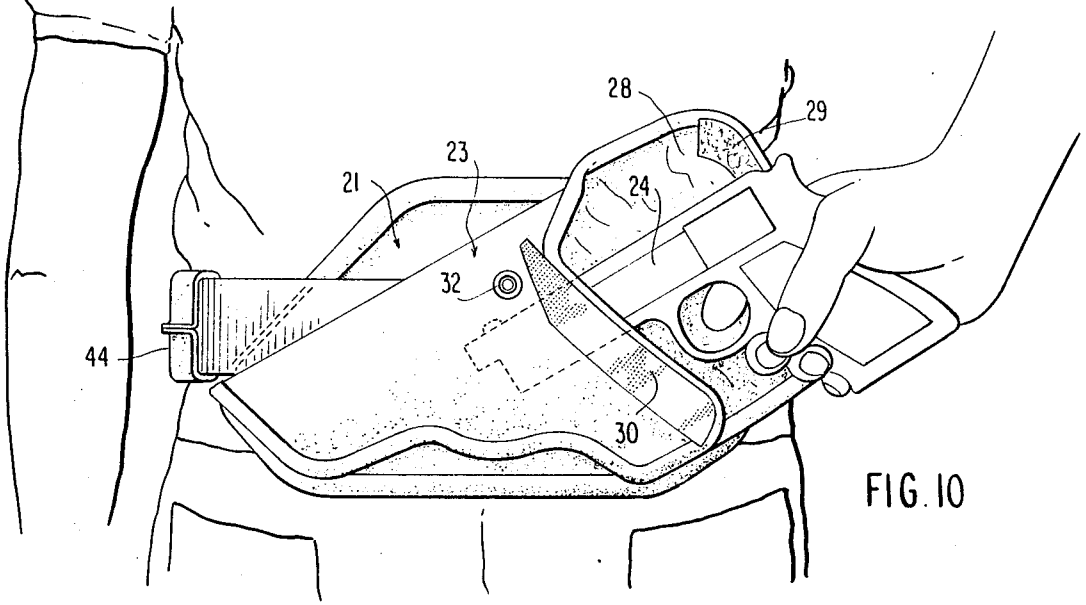
FIG. 10 is a view similar to FIG. 1 showing the holster open and the weapon being withdrawn therefrom by the wearer of the holster.

The advantages inherently possessed by the embodiment of the invention shown in FIGS. 11 and 12 are substantially identical with those described in connection with the prior embodiment of FIGS. 1 through 10. FIG. 10 depicts the method of drawing the weapon from the holster located on the back of a wearer. The closure flap 28 is easily opened by the fingers and the withdrawing of the weapon 24 is accomplished in a natural and swift manner and is actually facilitated by the angle of the holster body 23. The method of drawing the weapon is the same for all embodiments of the present invention.

Figure 13:
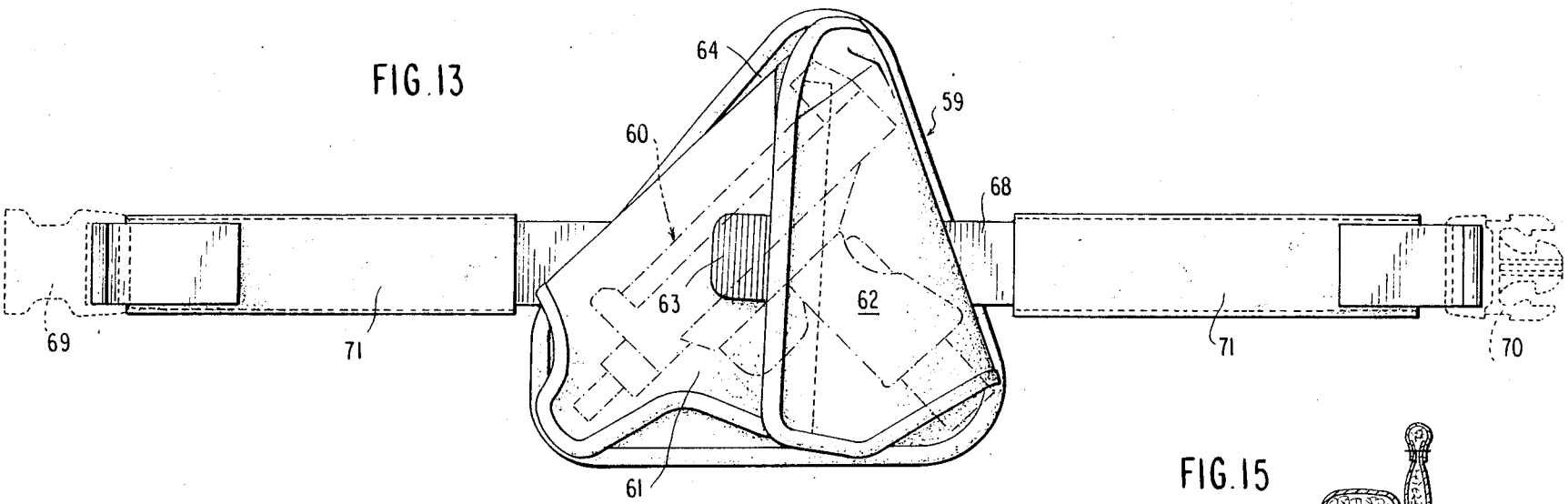
FIG. 13 is an exterior side elevation of a holster and support belt in accordance with a third embodiment of the present invention.
Figure 15:
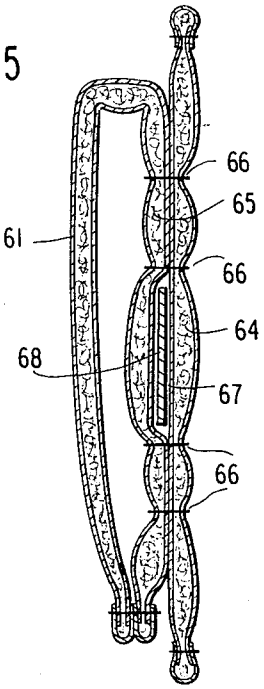
FIG. 15 is a vertical section on an enlarged scale taken on line 15—15 of FIG. 14.
Figure 14:
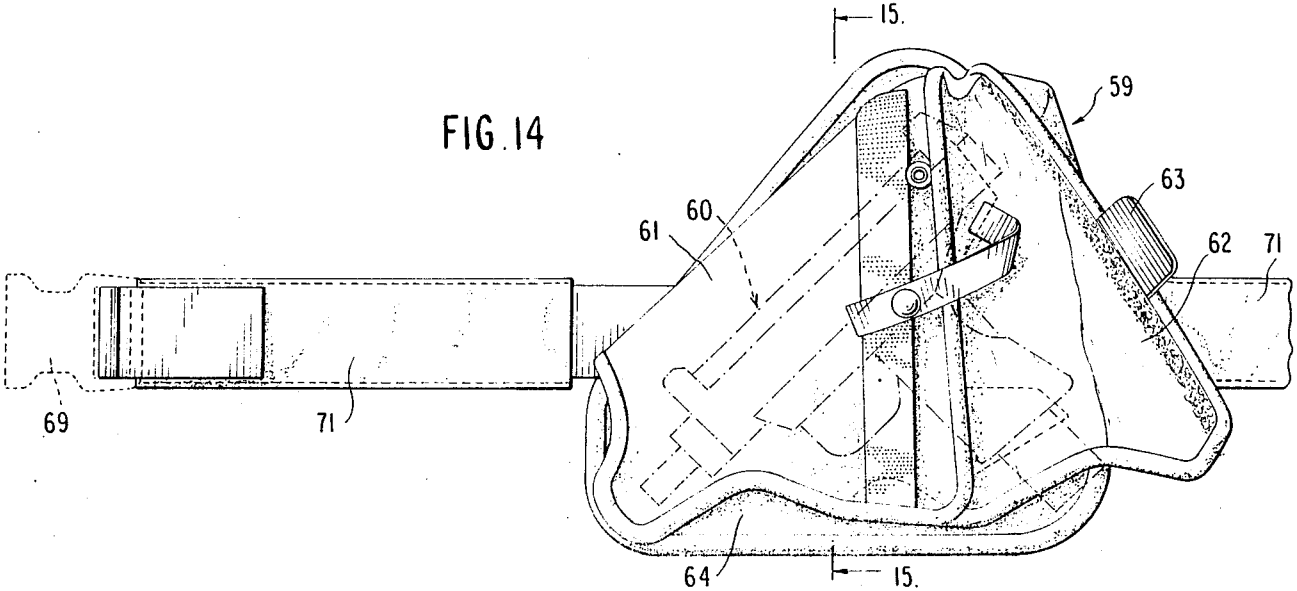
FIG. 14 is a further elevational view, similar to FIG. 13, showing the holster closure flap in an open position.

FIGS. 13 to 15 of the drawings show a third embodiment of the invention in which the holster assembly 59 is constructed to hold an assault pistol 60, such as an Uzi assault pistol or various others. Heretofore, there have been no known holsters for such large hand weapons and the present invention satisfies this need.

The holster assembly 59 includes a holster body 61 of roughly triangular shape having a Velcro-secured closure flap 62, preferably equipped with a pull tab 63. The natural balanced state of the pistol 60 through its center of gravity places the barrel axis at a steeper angle of inclination to the horizontal than in the prior embodiments of the invention.

An approximately triangular back pad 64 is fixed to the interior wall 65 of the holster body 61 by lines of stitching 66, as shown in FIG. 15. A movement passage or slot 67 for the holster support belt 68 is provided between two parallel lines of stitching, FIG. 15. Therefore, the belt 68 is longitudinally slidable relative to the holster body 61 and back pad 64, which elements are fixed relative to each other.

The holster body, back pad and support belt are constructed from the same tough conformable textile materials and padding described in the previous embodiments.

The belt 68 is equipped at its opposite ends with quick release fastener elements 69 and 70 and padding elements 71 are provided on the belt 68 as previously described, and are adjustable by sliding longitudinally along the belt 68, thus rendering the holster assembly fully adjustable so that the rather large holster body 61 and back pad 64 can be comfortably located within the natural recess afforded by the small of the back. This natural recess is sufficiently large to accept any of the disclosed forms of holster bodies and back pads with comfort.

When the holster assembly 59 is secured snugly to the body by means of the adjustable strap 68, or belt, even the relatively heavier weapon 60 will be stably supported with only minimal movement during strenuous physical activity for the reasons described previously in detail. The same geometric relationship between the center of gravity of the body and the center of gravity of the balanced holstered weapon exists in all embodiments of the invention.

In all forms of the invention, the barrel axis of the holstered weapon in the balanced state of the weapon forms an acute angle with the longitudinal axis of the support belt, which is in a substantially horizontal plane through the center of gravity of the body. This places the hand grip of the weapon upwardly and toward one side of the wearer's body at a very convenient angle to facilitate withdrawing the weapon from the holster body. This is in contrast to the most commonly used hip and thigh location of pistol holsters where the barrel axis of the pistol is nearly vertical. Such an arrangement could not be employed in a back-mounted holster because it would be difficult, if not impossible, to draw the pistol from the holster along a nearly vertical axis.

While the holster assemblies according to the invention are illustrated for use by right-handed persons, the invention is in no sense restricted in this way, and the holster assembly can also be constructed for left-handed users embodying the identical principles described in the application.

In its essentials, therefore, the invention comprises a waist-encircling padded support belt which is longitudinally adjustable at both ends and equipped with padding. A united holster body and back pad are carried by the support belt substantially at its longitudinal center so that the holstered weapon can be placed at the small of the back and centered on the back, with the quick-release fastener elements located centrally at the front of the waist or abdomen. It is also necessary that the holster body and the balanced weapon therein be inclined on an acute angle to the horizontal plane of the support belt and that the holster body be equipped with an easily releasable closure element, whereby the wearer can conveniently grasp the hand grip of the pistol and withdraw the pistol along the inclined axis of its barrel.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A pistol holster assembly comprising:

a united holster body and back pad, a waist-encircling belt carrying the united holster body and back pad and having releasable fastener means, the united holster body and back pad during use being worn on the back of a wearer of the assembly with the center of balance of a pistol contained in the holster body located substantially on a horizontal axis substantially coinciding with the horizontal axis through the center of gravity of the body of a wearer of the assembly, said back pad being arranged forwardly of the holster body relative to the back of a wearer and directly engaging and lying within the small of the back and being sufficiently large in area to span to a substantial degree the area of the small of the back and having a contoured marginal edge which approximately matches the natural contours of the small of the back thereby causing the back pad to be centered and stabilized while in contact with the small of the back, the holster body being disposed with a pistol barrel receiving portion thereof at an acute negative angle to the horizontal, and the holster body being of a size spanning a major portion of the area of the back pad both horizontally and vertically, the combined thicknesses of the united holster body and back pad being such that the assembly can lie substantially within a natural cavity defined by the small of the back.

2. A pistol holster assembly as defined in claim 1, and the contoured marginal edge of said back pad including two upwardly convergent opposite side edge portions and a bottom horizontal edge portion adjacent to the hips of a wearer of the assembly and extending for a substantial portion of the width of the hips.

3. A pistol holster assembly as defined in claim 2, and the contoured marginal edge of the back pad being roughly triangular with the base of the triangle disposed lowermost and substantially horizontally.

4. A pistol holster assembly as defined in claim 3, and the contoured marginal edge of the back pad being substantially trapezoidal.

5. A pistol holster assembly as defined in claim 1, and said united holster body and back pad being formed to provide between them a horizontal passage receiving said belt slidably and longitudinally adjustable relative to the holster body and back pad.

6. A pistol holster assembly as defined in claim 5, and padding elements on said belt on opposite sides of the united holster body and back pad.

7. A pistol holster assembly as defined in claim 6, and said padding elements being longitudinally adjustable on said belt.

8. A pistol holster assembly as defined in claim 1, and the united holster body and back pad each having a fabric envelope and padding contained within said envelope.

9. A pistol holster assembly as defined in claim 8, and the holster body and back pad being united by stitching.

10. A pistol holster assembly as defined in claim 1, and said holster body having a closure flap and quick-release fastener means for the closure flap.

11. A pistol holster assembly particularly for machine pistols and other large hand guns comprising:

a united padded holster body and back pad, a waist encircling belt carrying the united holster body and back pad and being longitudinally adjustable within a tunnel passage formed between the united holster body and back pad, said back pad being arranged forwardly of the holster body relative to the back of a wearer and having a padded marginal edge engaging the small of the back and being sufficiently large to span the major portion of the area of the small of the back, said padded marginal edge of the back pad being shaped to engage the natural contours of the small of the back thereby causing the assembly to be centered and stabilized while in contact with the small of the back, said holster body spanning a major portion of the area of the back pad and having a pistol barrel receiving portion disposed at an acute negative angle to the horizontal, whereby a pistol held within the holster body has its center of gravity and center of balance substantially coaxially aligned with a horizontal axis through the center of gravity of a wearer of the assembly, and the united holster body and back pad with a pistol contained in the holster body having a combined thickness enabling the united holster body and back pad to lie substantially within a natural cavity defined by the small of the back.

* * * * *